US007383642B1

(12) United States Patent
Maya

(10) Patent No.: US 7,383,642 B1
(45) Date of Patent: Jun. 10, 2008

(54) APPARATUS AND METHOD FOR THE TREATMENT AND PRESERVATION OF WOOD MATERIALS

(75) Inventor: Antonio Cesar Giraldo Maya, Alcala del Valle (CO)

(73) Assignee: Sustainable Communities, Santa Fe, NM (US)

( * ) Notice: Subject to any disclaimer, the term of this patent is extended or adjusted under 35 U.S.C. 154(b) by 508 days.

(21) Appl. No.: 11/002,534

(22) Filed: Dec. 1, 2004

(51) Int. Cl.
*F26B 7/00* (2006.01)

(52) U.S. Cl. ..... 34/396

(58) Field of Classification Search ..... 34/396, 34/446, 90

See application file for complete search history.

(56) References Cited

U.S. PATENT DOCUMENTS 2,884,707 A * 5/1959 Sandback ..... 34/491
3,448,002 A * 6/1969 Bryce et al. ..... 162/19
4,473,351 A * 9/1984 Hill ..... 432/2
4,810,510 A * 3/1989 Lever et al. ..... 426/233
5,972,401 A * 10/1999 Kowalski ..... 426/314
RE36,728 E * 6/2000 Ishii ..... 34/396

* cited by examiner

*Primary Examiner*—S. Gravini
(74) *Attorney, Agent, or Firm*—Rodey, Dickason, Sloan, Akin & Robb, PA

(57) ABSTRACT

An apparatus and method for the treatment and preservation of wooden materials includes depositing wooden materials to be treated into a confined, thermally insulated container and introducing smoke from a charcoal oven into that space to heat that space and treat the wooden materials. After a pre-determined amount of time of exposure to the treatment smoke at a controlled temperature and humidity level, the wooden materials will exhibit increased resistance characteristics.

8 Claims, 8 Drawing Sheets

APPARATUS AND METHOD FOR THE TREATMENT AND PRESERVATION OF WOOD MATERIALS

FIELD OF THE INVENTION

The present invention relates to the field of preservation of untreated wood. More specifically, the apparatus and method of the present invention relates to treating wooden materials using carbon based smoke in a temperature and humidity controlled environment.

BACKGROUND OF THE INVENTION

The use of wood as a building material has existed for centuries. Wood is a material that has been in abundant supply and has characteristics, such as durability, flexural, compressive and tensile strength, which make a nearly ideal material for structural constructions. However, wooden materials can be weather and time sensitive and can degrade, thus necessitating the need to treat the wood to enhance its natural characteristics and guard against this deterioration.

More specifically, one of the drawbacks of utilizing wooden materials is penetration by insects, microbial agents, and climatic conditions such as temperature and climate changes. Attempts to solve this problem included chemical treatments of woods using various chemicals such as creosote pressure-treated wood, pentachlorophenol pressure-treated wood, and inorganic arsenical pressure-treated wood. However, these treatments necessitate the handling and utilization of potentially hazardous chemicals, some of which are regulated by the Environmental Protection Agency. Once such common chemical treatment of wood has been the use of chromate copper arsenate, also known as CCA or arsenicum. CCA has been used to pressure treat lumber used for decks, playgrounds (play-sets) and other outdoor uses since the 1930's. Since the 1970's the majority of the wood used in residential settings was CCA-treated wood. However, due to CCA containing arsenic, a known carcinogen, any exposure to such a chemical is potentially hazardous to human health.

Thus, what is needed is a method to extend the useful duration of wood without using chemicals to accomplish the treatment.

OBJECTS OF THE INVENTION

It is one object of the present invention to provide a method and apparatus for the treatment of wood.

It is a further object of the present invention to provide for a method and apparatus for the treatment of wood which uses a natural process and not potentially harmful chemicals.

It is still a further object of the present invention to use low value small diameter and as well non-native trees to produce fumes, heat, humidity and smoke during a charcoal process to naturally treat wood.

It is a further object of the present invention to provide for a confined space in which to treat wooden materials through the use of natural smoke.

It is a further object of the present invention to provide for a means to produce and capture condensate of smoke produced from a charcoal oven.

SUMMARY OF THE INVENTION

The present invention is a method for the treatment of wooden materials. The invention functions by enclosing the wooden materials desired to be treated into a treatment space. This treatment space can be as small or as large as the materials to be treated, which can be as small as 3 cubic feet or as large as 60 feet tall by 45 feet long and/or wide.

This treatment space is then heated to a temperature of between 45 and 70 degrees Celsius. The heating is provided by the partial combustion of porous carbon from wood. Fumes, smoke, humidity, and resins are also generated from the partial combustion of porous carbon. These fumes, smoke, humidity and resins are used to treat the wooden materials and are subsequently condensed and captured such that they can be used for other uses (e.g. homeopathic use of the resin as an anti-fungal agent.)

The partial combustion of porous carbon creates a wood charcoal in a separate oven or pit process, while these fumes, humidity, resins, and heat are channeled through a pipe directly into the wood preservation chamber of the present invention. Generally, the input for this pipe is at the vertically low end of the preservation chamber, with the partial combustion of porous carbon taking place lower than the preservation chamber to allow for the smoke, humidity, fumes and resins to move upward through the pipe connecting the preservation chamber and the carbon oven or ovens. More generally, however, any means for inputting that smoke into the treatment chamber can be used.

The wooden construction materials are placed in the wood preservation chamber. The wood preservation chamber is heated and filled with the smoke, humidity, fumes and resins from the combustion of the porous carbon. There are one or more openings used to exhaust the smoke, humidity, resins and fumes in the preservation chamber. The heat, humidity, smoke and resins first serve to dilate the pores of the wooden materials (based on the introduction of heat into the chamber) which further allows for greater penetration of the smoke and resins which ultimately results in a more effective treatment.

The present invention is also comprised of a conduit, which can be made of plastic, rubber or metal, which travels transversely along the walls and ceiling of the preservation chamber. This closed circuit conduit is used to transport a cooling liquid that is at a temperature less than the ambient temperature of the chamber. The purpose of the pipe is to maintain a nearly constant temperature within the chamber according to the parameters described above. This conduit also functions to lower the ambient humidity within the chamber by allowing the humidity to condense on the conduit due to its lower temperature. The condensed liquid is then removed from the chamber. This condensed liquid will contain water and a resin derived from the charcoal process and is collected for other uses (e.g. homeopathic uses).

The cooling liquid provided from an external storage unit and continuously circulated through the pipe using a pump or other pressurization means.

The process of treatment can range from 10 to 60 days depending on the wood and density of the wood being treated and the physical characteristics of that wood.

The porous carbon used in the preservation process is also removed from a separate oven periodically and used as a natural charcoal product.

DESCRIPTION OF THE PREFERRED EMBODIMENT

Whereas the drawings and accompanying description have shown and described the preferred embodiments, it should be apparent to those skilled in the art that various changes may be made in the form of the invention without affecting the scope thereof.

Figure 1:
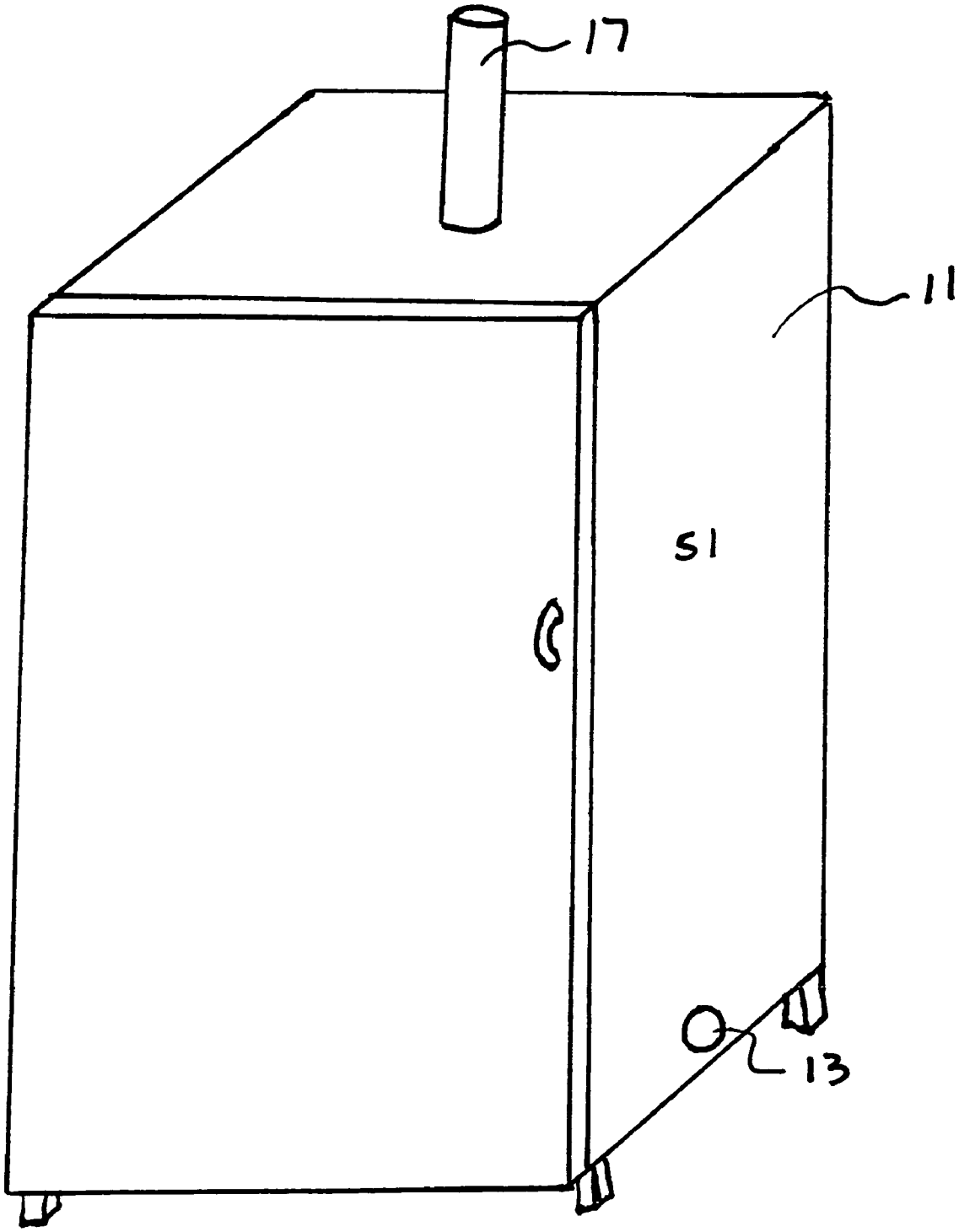
FIG. 1 depicts the wood preservation chamber of the present invention.

With reference to FIG. 1, the wood preservation chamber 11 of the present invention is depicted. Chamber 11 is used to store and treat desired wooden materials (shown in later figures). The treatment is primarily conducted by allowing smoke, humidity, fumes, and resins (herein after collectively referred to as "smoke") from a wood charcoal oven (shown in later figures) to be introduced into chamber 11 through inlets 13 and 15 (not shown in later figures). In the current embodiment, the charcoal oven will be located in an area remote to treatment chamber 11 and a conduit (not shown) will direct the smoke to treatment chamber 11, but other embodiments for introducing the smoke can be used. The smoke will then pass through chamber 11, simultaneously and continuously treating the wooden materials (shown in later figures) before being outputted through stack 17. Again, other exhaust means are contemplated by the present invention and stack 17 is only one embodiment for achieving the desired exhaust effect. Stack 17 may be variable in sizes, ranging from one foot in length up to twenty feet in length and may include various filters to clean the smoke before being exhausted into the environment.

Figure 2:
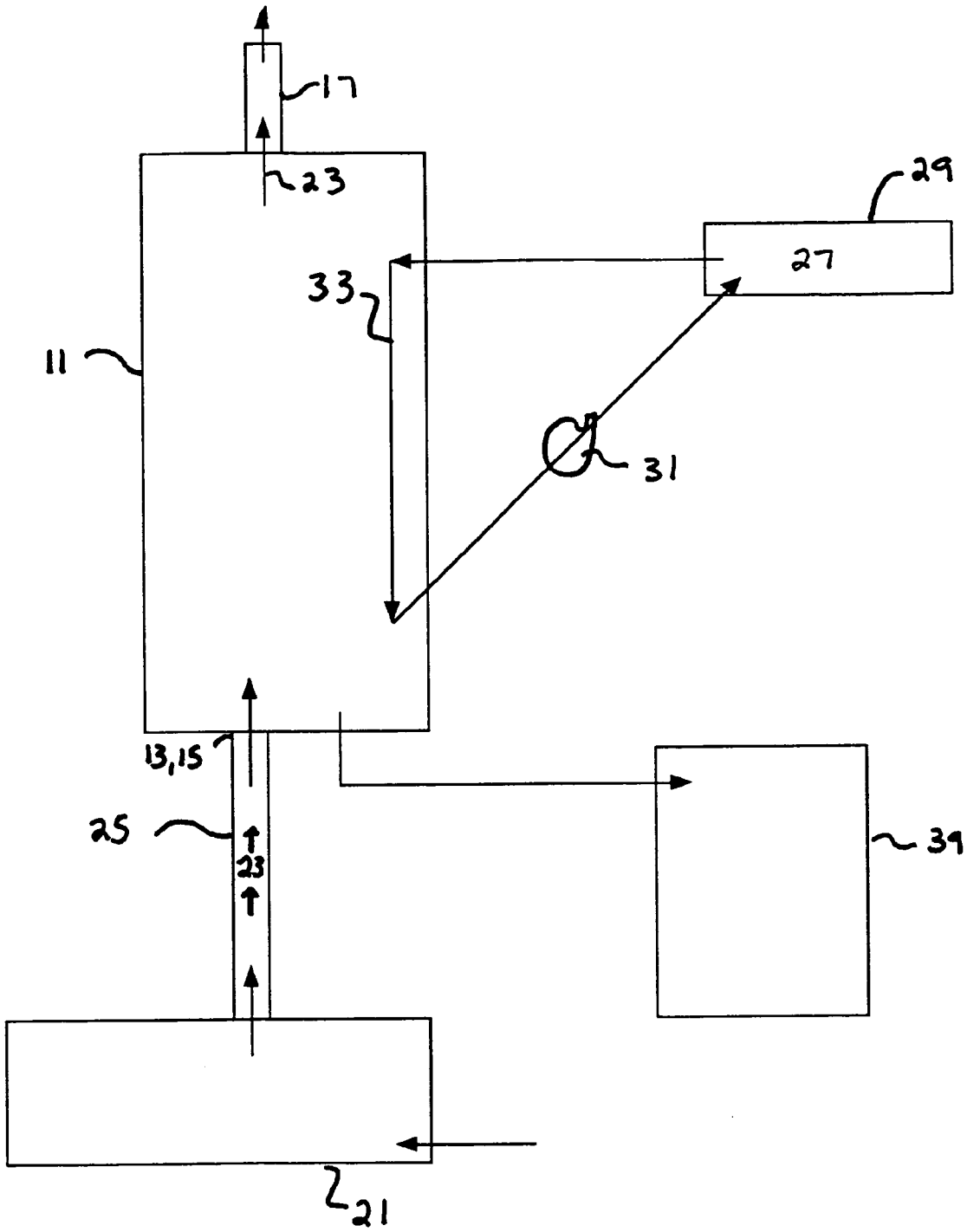
FIG. 2 is a flow diagram outlining the method of practicing the present invention.

FIG. 2 depicts the general flow diagram of the process and method of the present invention. First, charcoal oven 21 will produce the treatment smoke 23. Treatment smoke 23 will be produced through the controlled combustion of wooden materials (such as, but not limited to pinon, ponderosa, juniper, Encino, oak, salt cedars, Russian olives, and the majority of other wood types) to produce treatment smoke, 23. Treatment smoke 23 will be comprised of moisture, resin, fumes. Treatment smoke 23 will be transported to preservation treatment chamber 11 through various means including, as an example, conduit 25. Simultaneously, cooling liquid 27 contained within storage tank 29 will be pumped using pump 31 into cooling conduit 33 contained within preservation treatment chamber 11. Treatment smoke 23 will either be absorbed by treatment materials (not shown) or will be exhausted through stack 17. This process will continue until the treatment materials are adequately treated which may take from 10 to 60 days. During the treatment process, condensate from treatment smoke 23 will be collected within treatment chamber 11 and ultimately transported to and collected in condensate storage 39.

Figure 3:
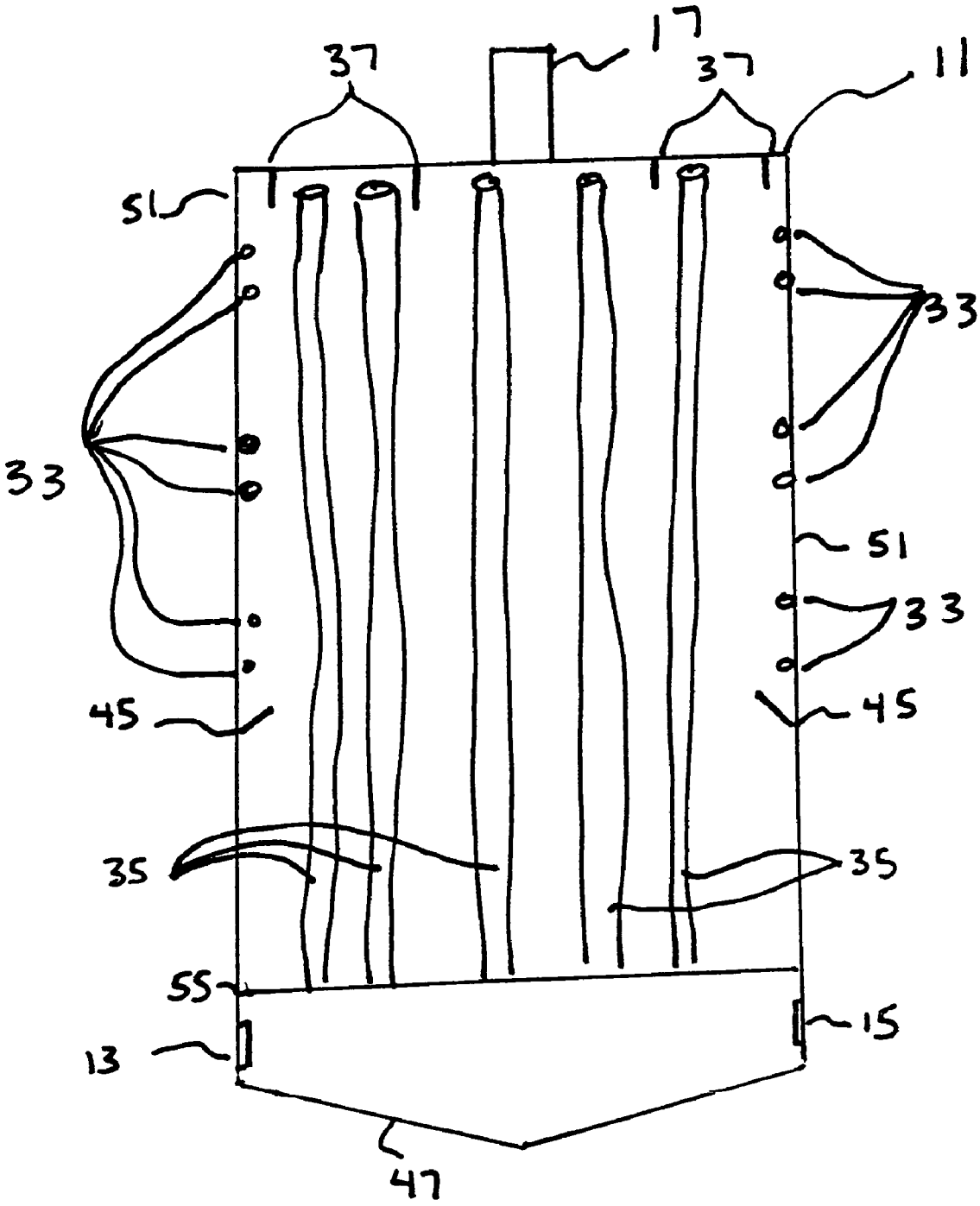
FIG. 3 depicts a cross section of the wood preservation chamber when at least partially filled with wood.

With reference to FIG. 3, treatment materials will be inserted into the interior of treatment chamber 11. Material guides 37 will insure that the materials 35 remain upright and are not in contact with the cooling conduit 33. In operation, treatment smoke 23 will be introduced into treatment chamber 11 through inputs 13 and 15. Treatment smoke will then rise through treatment chamber 11 and will either be absorbed by treatment materials 35 or will be exhausted through stack 17.

Figure 4:
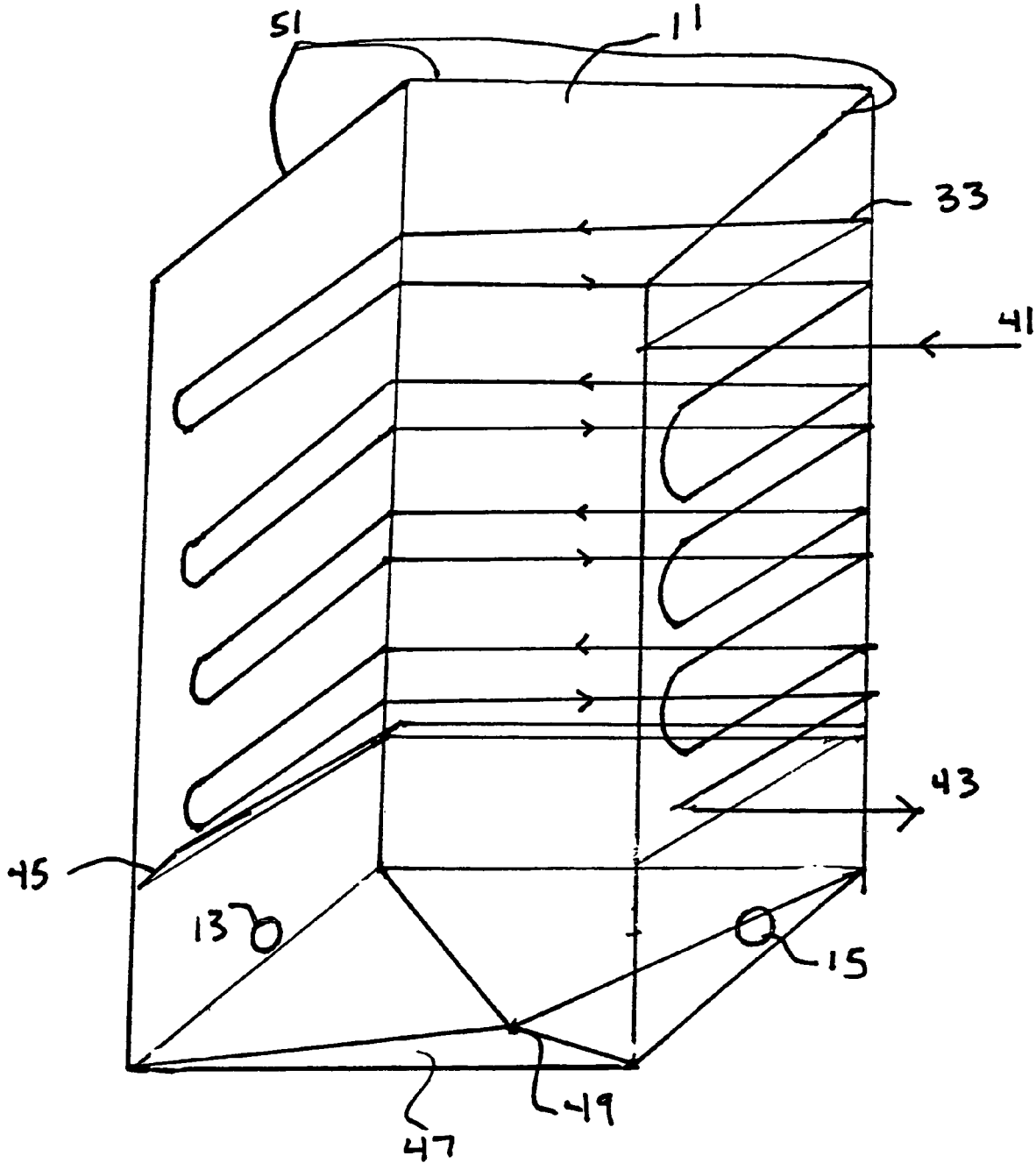
FIG. 4 depicts the interior of the wood preservation chamber, specifically referencing the cooling pipes.

Next with reference to FIG. 4, the operation and function of cooling conduit 33 is described. A cooling liquid is supplied to cooling pipe 33 from cooling liquid storage tank (not shown). First the cooling liquid is pressurized by a pump (not shown) and is introduced into treatment chamber 11 through input 41. The cooling liquid is allowed to circulate through the conduit until it reaches output 43 where it is returned to the cooling liquid storage tank (not shown). The purpose of cooling conduit 33 is two fold. First, cooling pipe is used to prevent treatment chamber 11 from exceeding a certain temperature. The temperature within treatment chamber is maintained between 45° and 70° Celsius, but is preferred to be 60° Celsius. Second, cooling conduit 33 serves to condense moisture and resin from treatment smoke 23. This moisture and resin mixture is allowed to condense on cooling pipe 33 until it ultimately releases and is caught by trough 45 or is allowed to proceed to floor 47 of treatment chamber 11. Floor 47 is constructed such that any moisture resin mixture will gravity flow to output 49.

With further reference to FIG. 4, the dimensions and characteristics of treatment chamber 11 are described. Generally, chamber 11 will be dimensioned according to the treatment materials 39 being treated. For instance, if treatment materials 35 are smaller pieces of wood, treatment chamber 11 may have a volume of 3 cubic feet. However, much larger materials can be treated using the same process described herein and may assume dimensions as large as 60 feet tall, 45 feet wide and/or long. Chamber walls 51, can be constructed through the use of any temperature resistant material which can not only withstand the ambient temperature within treatment chamber 11 but will also provide insulation such that the ambient temperature within treatment chamber 11 can be monitored and controlled.

Figure 5:
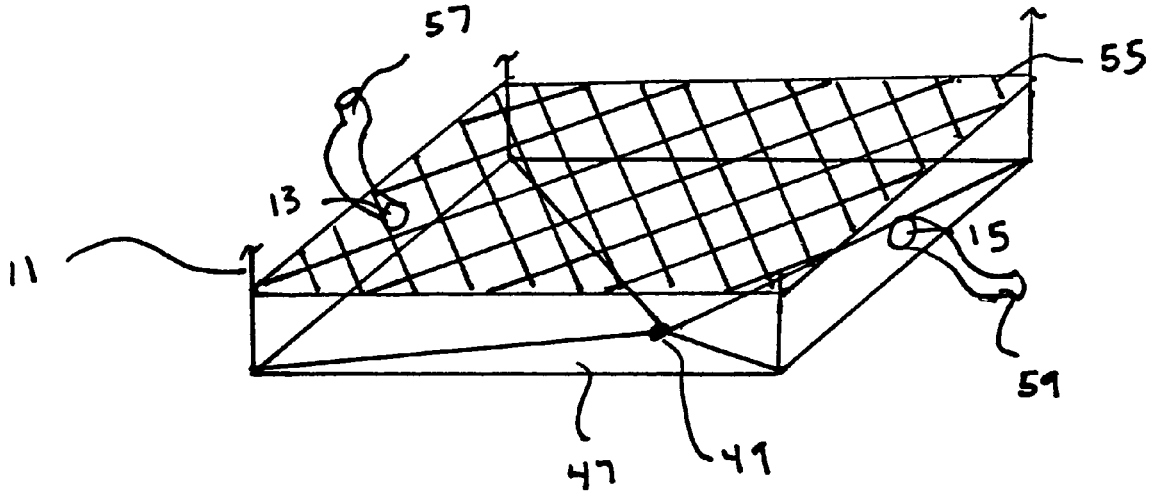
FIG. 5 depicts the lower portion of the wood preservation chamber.

With reference to FIG. 5, floor 47 (and the entire interior of the preservation chamber) is constructed of temperature resistant materials such as stainless steel and is generally between ⅛ inches and ⅜ inches thick and can be insulated with fiberglass or other similar no-combustible insulation. Floor 47 is constructed such that the entire floor surface drains into outlet 49. In some embodiments of the present invention, floor 47 is used to collect the condensate produced from the interaction between the cooling conduit (not shown) and the treatment smoke 23 which, as described above, is introduced into treatment chamber 11 through inlets 13 and 15. Inlets 13 and 15 are integrally connected to treatment smoke conduits 57 and 59. These conduits are connected to the charcoal ovens (not shown) and function to transport treatment smoke 23 from said ovens to treatment chamber 11. Conduits 57 and 59 can be constructed from various materials including but not limited plastic piping, steel piping or durable hosing and have a generally diameter in the range of 3 to 15 inches.

With further reference to FIG. 5, grate 55 provides both vertical support for the materials being treated in chamber 11 and also spatial separation in order to allow treatment smoke 23 to enter treatment chamber 11 from inlets 13 and 15 and be disbursed throughout the treatment chamber 11 before coming into contact with the materials being treated. Grate 55 is preferably an expanded metal grate but can be any material that is both temperature resistant and capable of supporting the load produced by the treatment materials shown).

Figure 6:
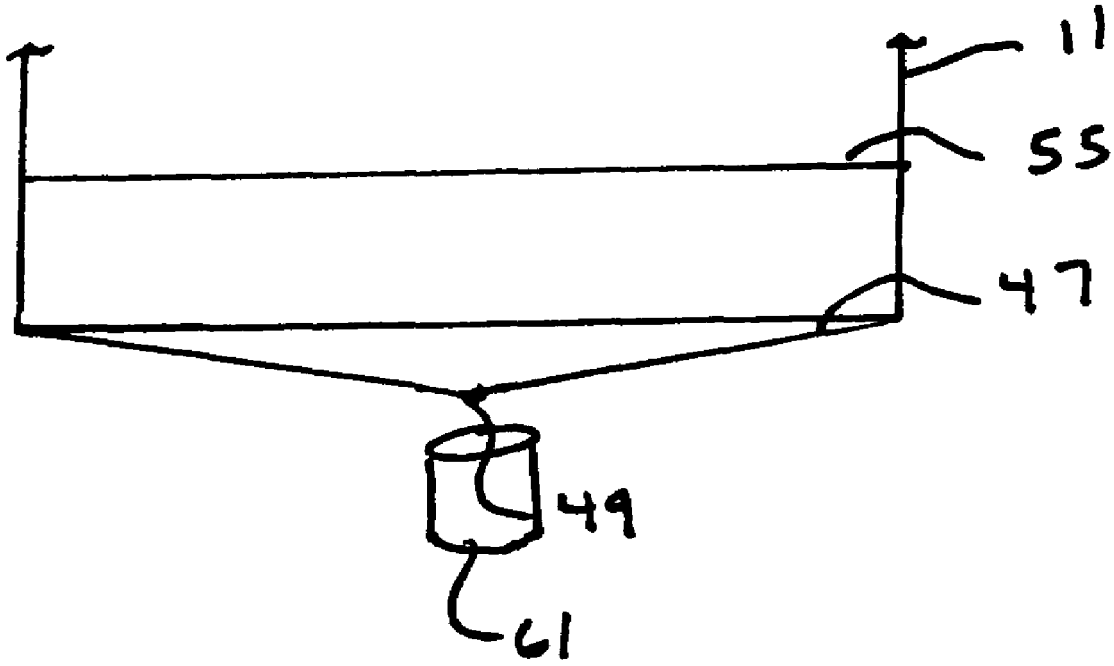
FIG. 6 depicts a cross section of the wood preservation chamber.

FIG. 6 is a cross sectional view of floor 47 and grate 55 of treatment chamber 11. FIG. 6 depicts the angle of repose of floor 47 allowing for any accumulated liquid to be transported to outlet 49. The angle of repose must be only of a magnitude to allow for the flowing of the condensate, and while outlet 49 is shown as being in the middle of floor 47, it can be located at any position along within floor 47 such that any condensate is allowed to flow to it. This condensate can be collected in receptacle 61 in order to be used for other purposes, including but not limited homeopathic remedies. Receptacle 61 may be connected to piping or other outlets (not shown) in order to remove that condensate from underneath treatment chamber 11.

Figure 7:
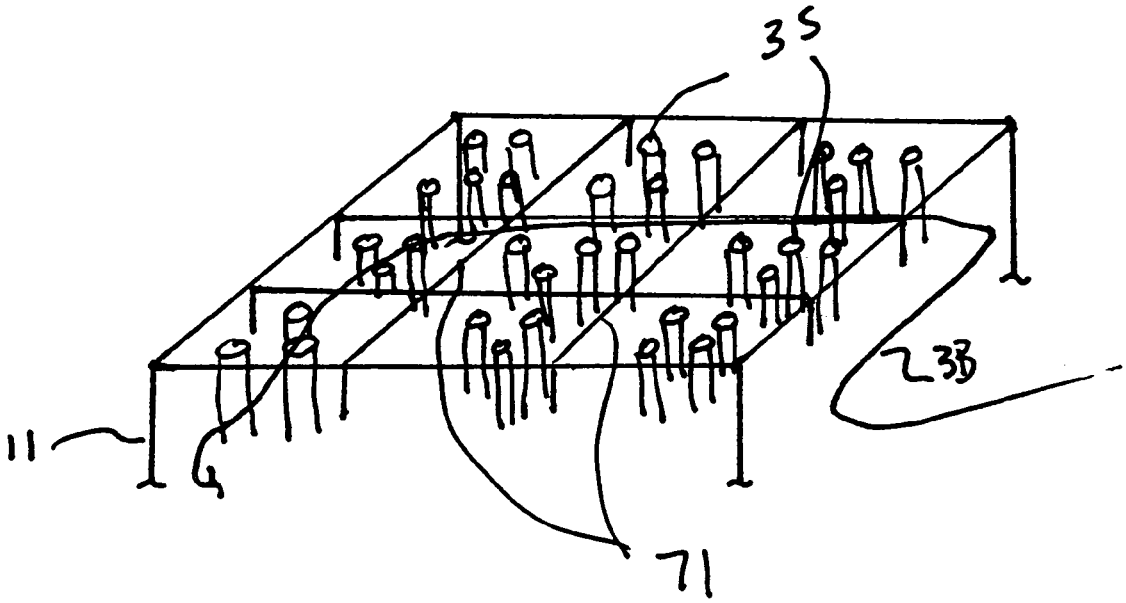
FIG. 7 depicts the liquid removal apparatus of the wood preservation chamber.

FIG. 7 illustrates the treatment materials management grid 71 of the present invention. This grid is comprised of the material guides shown with respect to FIG. 3. The purpose of grid 71 is to ensure the proper distribution of treatment materials 35 within treatment chamber 11. As shown, treatment chamber is divided into nine separate compartments but could be divided into any number of different compartments based upon the thickness of the materials being treated and according to user preferences. Grid 71 will also serve the purpose of ensuring that treatment materials 35 do not come into contact with cooling conduit 33.

Figure 8:
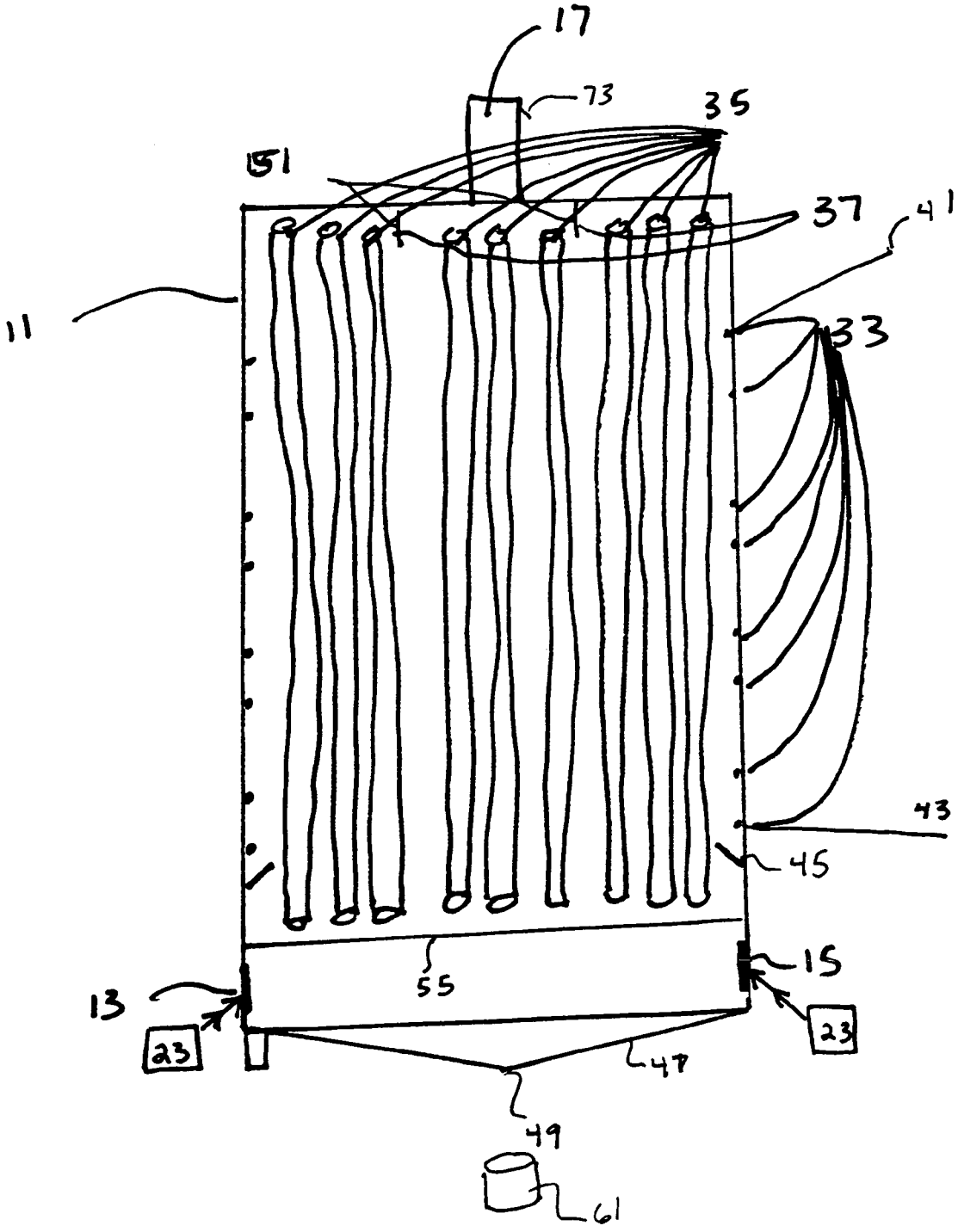
FIG. 8 depicts the wood management grid located in the uppermost portion of the wood preservation chamber.

In operation, with reference to FIG. 8, treatment materials 35 will be inserted into treatment chamber 11 such that they are generally equally spatially separated using material guides 35 within materials management grid 71 (not shown). Treatment smoke will then be introduced into treatment chamber through inlets 13 and 15. Simultaneously, cooling liquid from cooling liquid storage tank will be pumped through cooling pipes 33. As condensate from treatment smoke condenses on cooling pipes 33, it will either be collected by trough 45 or will proceed to floor 47 and be directed towards output 49 where the condensate can be collected by receptacle 61. Some embodiments may utilize either or both of trough 45 and/or output 49 in order to collect the condensate.

With continued reference to FIG. 8, treatment smoke 23 will travel throughout treatment chamber 11 and will be absorbed into treatment materials 35. To the extent not absorbed, treatment smoke 23 will be exhausted through stack 17. Stack 17, in some embodiments will be equipped with butterfly valve 73 which will function to regulate the amount of treatment smoke 23 and heat within treatment chamber 11.

What is claimed is:

1. A method for the treatment of wooden materials, said method comprising the steps of a. providing wooden materials to be treated;

b. inserting said wooden materials into a confined, thermally insulated space;

c. heating said space by introducing smoke produced from the combustion of carbon based materials;

d. allowing said wooden materials to absorb said smoke;

e. controlling the temperature within said confined space;

f. treating said wooden materials for a predetermined time;

g. extracting said wooden materials from said space after said pre-determined time.

2. The method of claim 1 further including the step of removing moisture from said wooden materials.

3. The method of claim 1 further including the step of removing moisture from said smoke.

4. The method of claim 1 wherein the step of controlling the temperature within said confined space includes the step of circulating, within a cooling coil within said confined space, a cooling liquid.

5. The method of claim 1, further including the step of condensing portions of said smoke into a condensate.

6. The method of claim 5, further including the step of removing said condensate from said confined space.

7. The method of claim 1 wherein said step of condensing includes the step of circulating, through a closed loop located inside said space, a cooling liquid that is at a temperature less than that of the ambient temperature of said space.

8. The method of claim 1, wherein said step of heating is accomplished by combusting porous carbon.

* * * * *